US009560699B2

(12) United States Patent
Zhylkov et al.

(10) Patent No.: US 9,560,699 B2
(45) Date of Patent: Jan. 31, 2017

(54) MICROWAVE PROCESSING CHAMBER

(75) Inventors: Valerie S. Zhylkov, Kharkov (UA); James H. Brownell, Wilmington, DE (US); Stanislav Zhilkov, Philadelphia, PA (US); Alexei V. Smirnov, Saint Claire, PA (US)

(73) Assignee: Upscale Holdings, Inc., Cambridge, MA (US)

( * ) Notice: Subject to any disclaimer, the term of this patent is extended or adjusted under 35 U.S.C. 154(b) by 956 days.

(21) Appl. No.: 13/263,168

(22) PCT Filed: Apr. 8, 2010

(86) PCT No.: PCT/US2010/030444
§ 371 (c)(1),
(2), (4) Date: Jun. 28, 2012

(87) PCT Pub. No.: WO2010/118267
PCT Pub. Date: Oct. 14, 2010

(65) Prior Publication Data
US 2012/0305808 A1 Dec. 6, 2012

Related U.S. Application Data

(60) Provisional application No. 61/212,324, filed on Apr. 8, 2009.

(51) Int. Cl.
*H05B 6/72* (2006.01)
*H05B 6/74* (2006.01)
(Continued)

(52) U.S. Cl.
CPC ..... *H05B 6/6402* (2013.01); *H05B 6/704* (2013.01); *H05B 6/72* (2013.01); *H05B 6/705* (2013.01);
(Continued)

(58) Field of Classification Search
CPC .. B29C 65/14; B29C 65/1425; B29C 66/1122; H05B 6/705; H05B 6/72; H05B 6/78; H05B 6/64; H05B 6/707; H05B 6/74; A61B 18/1492; A61B 18/1815; A61B 18/18; A61N 7/02; A61N 5/04; A61N 5/0614; G21G 4/06; B82Y 10/00; H05H 3/02
(Continued)

(56) References Cited

U.S. PATENT DOCUMENTS 3,172,818 A 3/1965 Hibshman
3,366,769 A * 1/1968 Lima ..... 219/748
(Continued)

FOREIGN PATENT DOCUMENTS

RU 2028688 C1 2/1995
RU 2039461 C1 7/1995
(Continued)

OTHER PUBLICATIONS

International Search Report and the Written Opinion dated Jun. 3, 2010 for PCT Application No. PCT/US2010/030444.
(Continued)

*Primary Examiner* — Dana Ross
*Assistant Examiner* — Hemant Mathew
(74) *Attorney, Agent, or Firm* — Locke Lord LLP; Christopher J. Capelli

(57) ABSTRACT

An apparatus includes a chamber configured to support a number of quasi-orthogonal resonant modes, and at least one antenna assembly, where the antenna assembly includes an antenna having a radiating element, where (i) the antenna has predominantly linear polarization of radiation defined by a polarization plane, (ii) the radiating element is disposed within the chamber such that the polarization plane is not parallel and not perpendicular to the plane containing a
(Continued)

primary axis of the chamber and a central point of the radiating element, and (iii) each antenna is coupled to the chamber through a designated surface of the chamber and coupled to a source of microwave or radio frequency energy external to the chamber having a nominal operating frequency.

23 Claims, 12 Drawing Sheets

(51) Int. Cl.
*H05B 6/70* (2006.01)
*H05B 6/64* (2006.01)

(52) U.S. Cl.
CPC ..... *H05B 6/707* (2013.01); *H05B 2206/044* (2013.01)

(58) Field of Classification Search
USPC ..... 219/690, 691, 693, 695, 696, 697, 745,219/746, 747, 748, 749; 606/33, 32, 27; 607/101, 156; 156/379.6; 250/494.1, 503.1, 250/493.1, 251
See application file for complete search history.

(56) References Cited

U.S. PATENT DOCUMENTS

| | | | | |
|---|---|---|---|---|
| 4,284,868 | A | | 8/1981 | Simpson |
| 4,327,266 | A | * | 4/1982 | Austin et al. ..... 219/749 |
| 4,455,135 | A | * | 6/1984 | Bitterly ..... 432/1 |
| 4,463,239 | A | | 7/1984 | Miller |
| 4,510,697 | A | * | 4/1985 | Beasley et al. ..... 34/261 |
| 4,642,435 | A | | 2/1987 | Fitzmayer et al. |
| 4,695,693 | A | | 9/1987 | Staats et al. |
| 4,795,671 | A | | 1/1989 | Shiiki et al. |
| 4,795,871 | A | * | 1/1989 | Strattan et al. ..... 219/707 |
| 4,814,568 | A | | 3/1989 | Keefer |
| 5,320,804 | A | | 6/1994 | Zakaria et al. |
| 5,382,414 | A | | 1/1995 | Lautenschlager |
| 5,403,564 | A | | 4/1995 | Katschnig et al. |
| 5,672,316 | A | | 9/1997 | Knapp |
| 5,874,715 | A | * | 2/1999 | Choi ..... 219/746 |
| 5,932,075 | A | | 8/1999 | Strauss et al. |
| 6,033,912 | A | | 3/2000 | Lautenschlager |
| 6,084,226 | A | | 7/2000 | Greene et al. |
| 6,114,931 | A | | 9/2000 | Gevorgian et al. |
| 6,242,723 | B1 | | 6/2001 | Lautenschlager |
| 6,288,379 | B1 | | 9/2001 | Greene et al. |
| 6,558,635 | B2 | | 5/2003 | Minaee et al. |
| 6,720,540 | B2 | | 4/2004 | Fagrell |
| 6,744,024 | B1 | | 6/2004 | Hayes et al. |
| 6,917,023 | B2 | | 7/2005 | Hayes et al. |
| 6,989,519 | B2 | | 1/2006 | Collins, Jr. et al. |
| 7,041,947 | B2 | | 5/2006 | Collins, Jr. et al. |
| 7,109,452 | B2 | | 9/2006 | Collins, Jr. et al. |
| 7,214,913 | B2 | | 5/2007 | Collins, Jr. et al. |
| 2001/0045429 | A1 | | 11/2001 | Eke |
| 2002/0158066 | A1 | | 10/2002 | Dorr et al. |
| 2005/0019567 | A1 | | 1/2005 | Nixdorf |
| 2005/0034972 | A1 | | 2/2005 | Lautenschlager |
| 2005/0142059 | A1 | | 6/2005 | Kim et al. |
| 2005/0274065 | A1 | | 12/2005 | Portnoff et al. |
| 2006/0005769 | A1 | | 1/2006 | Ishibashi et al. |
| 2006/0026994 | A1 | | 2/2006 | Yoshizawa |
| 2006/0039838 | A1 | | 2/2006 | Barnhardt et al. |
| 2006/0291827 | A1 | | 12/2006 | Suib et al. |
| 2008/0117113 | A1 | | 5/2008 | Haziza |
| 2008/0233020 | A1 | | 9/2008 | Purta et al. |

FOREIGN PATENT DOCUMENTS

| | | | |
|---|---|---|---|
| RU | 2044479 | C1 | 9/1995 |
| RU | 2054829 | C1 | 2/1996 |
| RU | 2056020 | C1 | 3/1996 |
| RU | 2074531 | C1 | 2/1997 |
| RU | 2080746 | C1 | 5/1997 |
| RU | 2085057 | C1 | 7/1997 |
| RU | 2108009 | C1 | 3/1998 |
| RU | 2124278 | C1 | 12/1998 |
| RU | 2149520 | C1 | 5/2000 |
| RU | 2231934 | C1 | 6/2004 |
| RU | 2257018 | C2 | 7/2005 |
| RU | 2273117 | A | 10/2005 |
| RU | 2005129965 | A | 4/2007 |
| RU | 2006140923 | A | 5/2008 |
| RU | 2008137844 | A | 3/2010 |
| SU | 1251839 | A1 | 8/1986 |
| SU | 1727756 | A1 | 4/1992 |
| SU | 1746943 | A1 | 7/1992 |
| SU | 1752331 | A1 | 8/1992 |
| SU | 1764190 | A1 | 9/1992 |
| SU | 1798868 | A1 | 2/1993 |
| WO | WO-0243442 | A1 | 5/2002 |
| WO | WO-2008/070002 | A1 | 6/2008 |
| WO | WO-2008/115226 | A2 | 9/2008 |

OTHER PUBLICATIONS

International Preliminary Report on Patentability dated Oct. 20, 2011 for PCT Application No. PCT/US2010/030444.
Search and Examination Report dated Feb. 1, 2013 for Singapore Application No. 201107554-6.
Extended European Search Report for European Patent Application No. 10762462.9, dated Jan. 14, 2014.

* cited by examiner

SECTION C-C

MICROWAVE PROCESSING CHAMBER

CROSS-REFERENCE TO RELATED APPLICATIONS

This application is a U.S. National Phase of International Application No. PCT/US2010/030444, which claims priority to U.S. Provisional Patent Application Ser. No. 61/212,324, filed Apr. 8, 2009. This application is also related to U.S. patent application Ser. No. 12/313,806, filed Nov. 25, 2008. All of which are incorporated herein by reference in their entirety.

TECHNICAL FIELD

Embodiments of the present invention are related to apparatus for processing materials with microwave energy.

BACKGROUND

Various apparatuses for processing materials with microwave or radio frequency (RF) energy in closed chambers have been developed for home, commercial and industrial applications. The most well-known example is the ubiquitous microwave oven where, typically, a single source of microwave energy, a magnetron, delivers microwave energy to a rectilinear chamber through a waveguide or waveguide horn antenna with fixed polarization (polarization is a parameter that identifies the orientation of the electric field component the electromagnetic field in space and time). The operating frequency is usually selected as one of the standard industrial frequencies. The selected standard frequency is a result of a compromise between the absorption skin depth in the load material, efficiency of the source (usually a magnetron), and dimensions of both the load and the source including its power supply.

The deficiency in this basic approach is that the distribution of microwave energy is generally very non-uniform and inefficient. The microwave energy density is non-uniform because the resonant modes of the chamber, determined by the frequency of the magnetron and the dimensions of the chamber having typically a single power coupler, create wave patterns that can add both constructively and destructively (the resonant modes are known as Eigenmodes, which are solutions to the electromagnetic wave equations under the boundary conditions imposed by the chamber and the coupler and antenna). As a result, the distribution of microwave energy in the chamber is very non-uniform and the microwave oven generally exhibits hot spots and cold spots in a load. To remedy this deficiency, microwave oven manufacturers have introduced "stirring" mechanisms, which are essentially metallic "propellers" that constantly change the boundary conditions of the chamber to redistribute the microwave energy in the chamber. Another common approach is to provide a rotating food platform that moves the food in and out of the hot and cold spots in an attempt to average out the non-uniformities over the cooking time. The microwave ovens are inefficient because the impedance of the loaded chamber (dominated usually by the water content of the load, its distribution and the volume to be heated) as measured, for example, at the coupler port, is highly variable unlike the impedance of the microwave power source (a basic principal of power transfer efficiency is a match between the impedance of the source and the impedance of the loaded chamber). However, these approaches add cost and complexity, reduce reliability, limit minimum processing time, and are not generally applicable to higher power industrial applications such as heating, drying, sterilization, disinfection, polymerization, and chemical synthesis.

Conventional industrial chambers suffer from the same limitations as microwave ovens, and other limitations as well. Compared to home or commercial microwave ovens, industrial chambers used for heating, drying and chemical synthesis must often operate at much higher power levels (10's of kilowatts versus 1-2 kilowatts). Typically, these chambers are fed by two or more open-ended waveguides or horn antennas that can handle the high power levels, and which are rigidly fixed to the chamber wall. Variations in the load (the material that is being irradiated by the microwave energy), in terms of volume, density, distribution and dielectric constant, for example, can disrupt the distribution of resonant modes in the chamber, resulting in poor uniformity and efficiency. Having more than one coupler in a processing chamber helps to improve uniformity of processing, but also creates problem of mutual influence of these couplers (sources) known as intercoupling or cross-coupling. Additionally, it is very difficult to control cross-coupling between the antennas, which can detune the microwave sources and lead to further losses in uniformity and efficiency.

One approach to overcome these limitations is to employ a single-mode chamber, typically of dimensions smaller than approximately one wavelength, to support only one mode within the operating band of the sources. As a result, the maximum load size in single-mode chambers is less than a cubic wavelength or, for example, about 1 liter at 2.45 GHz. In order to process larger loads, chambers with dimensions larger than approximately one wavelength are required, but existing approaches do not adequately address the limitations of source intercoupling and interference mentioned above.

Other conventional approaches rely on "cross-polarization" between electromagnetic fields radiating from two different sources, which is the condition where the polarization plane, usually defined by the electric field component and direction of radiation propagation, emitted by one radiating element is perpendicular to that emitted by a second radiating element at all points within the volume of interest. Cross-polarized fields do not interfere, even if the corresponding sources are completely synchronized or coherent, such as when two radiating elements are driven by the same source, and so the time average power does not exhibit spatial or temporal interference fringes.

As is known in the art related to closed structures, cross-polarization is usually accomplished in rectangular waveguides or parallelepiped chambers so that the excited mode polarizations are perpendicular at every point (see, e.g., FIGS. 1-2 in U.S. Pat. No. 4,795,871). The '871 patent specifies conical and pyramidal walls that are not parallel or perpendicular but the orientation of the radiators is implied in FIGS. 3-8 as either parallel or perpendicular to the plane containing polar axis and the central point of the radiator.

The analysis in the '871 patent is based on essentially traveling waves propagating as an optical beam in an open space. In the presence of a non-rectilinear, closed chamber of dimensions comparable to approximately ten wavelengths, commonly used in domestic and industrial applications, the fields exist in a form of a discrete set of standing waves exhibiting a pattern of maxima and minima determined by the chamber geometry and its contents. The polarization of these standing waves in general are not mutually perpendicular at all points and therefore it is not obvious that any arrangement of multiple radiating elements can excite non-intercoupled modes.

SUMMARY

An apparatus according to one embodiment of the invention includes a chamber configured to support a plurality of quasi-orthogonal resonant modes and at least one antenna assembly comprising an antenna having a radiating element, wherein (i) the antenna has predominantly linear polarization of radiation, defined by a polarization plane, (ii) the radiating element is disposed within the chamber such that the polarization plane is not parallel and not perpendicular to the plane containing a primary axis of the chamber and a central point of the radiating element, and (iii) the antenna is coupled to the chamber through a designated surface of the chamber and coupled to at least one source of microwave or radio frequency energy having an operating frequency and positioned to launch one or more of the plurality of quasi-orthogonal resonant modes to be coupled to a load disposed within the chamber.

In one embodiment, the apparatus includes a plurality of antenna assemblies wherein each antenna is coupled to the chamber through the designated surface of the chamber and wherein intercoupling between antennas is minimized.

In one embodiment, an antenna assembly is configured to have mechanical degrees of freedom comprising at least one of (i) rotation about the normal direction to the primary plane of the radiating element, (ii) an angle of inclination of the normal direction to the primary plane of the radiating element relative to an axis of symmetry of the chamber, (iii) a radial distance from the axis of symmetry of the chamber, (iii) an azimuthal rotation around the axis of symmetry of the chamber, and (iv) a distance between a plane of the radiating element and the designated surface of the chamber.

In one embodiment, the designated surface of the chamber includes at least one substantially planar surface.

In one embodiment, the designated surface of the chamber includes at least one partially curved surface.

In one embodiment, the chamber has a shape selected from the group consisting of an ellipsoid, a spheroid, a sphere, a cylinder having (i) a polygonal or an elliptical cross section and (ii) two end-caps, each end-cap being at least one of flat, conical, pyramidal, ellipsoidal, spheroidal, spherical or polyhedron shape, and a combination thereof.

In one embodiment, the designated surface of the chamber has at least one partially curved surface in a shape of a first end-cap and a second end-cap, each end-cap includes one-half of an oblate spheroid and is interconnected with a cylindrical insert along matching edges.

In one embodiment, a plurality of antenna assemblies having two or more antennas is disposed upon an inner surface of the first end-cap and spaced at approximately equal angles around an axis of symmetry of the chamber.

In one embodiment, the plane of the radiating element is substantially parallel to a tangent plane at the intersection of the normal direction to the plane of the radiating element through a geometric center of the radiating element and the inner surface of the first end-cap.

In one embodiment, the antenna assembly further includes a coaxial transmission line having an outer conductor and an inner conductor, a reflecting element comprising a body having (i) a defined shape with a minimum dimension comparable to the radiating element maximum dimension, (ii) a substantially flat surface facing the radiating element, and (iii) an aperture, wherein the reflecting element is electrically connected to the outer conductor of the coaxial transmission line, wherein the radiating element is electrically connected to the inner conductor of the coaxial transmission line, the radiating element being substantially parallel to the substantially flat surface of the reflecting element and spaced from the substantially flat surface of the reflecting element by a gap, the radiating element comprising a single substantially planar body or a multi-part body comprising a combination of substantially planar bodies approximating one or more simply-connected geometric figures having a primary plane, and one or more conductive pins disposed between the radiating element and the reflecting element, the pins electrically bridging the gap between the reflecting element and the radiating element and disposed in proximity to a perimeter of the radiating element, wherein impedance and polarization of the antenna assembly are controlled.

In one embodiment, the radiating element includes two or more simply-connected geometric figures forming a coplanar surface and wherein the radiating element has substantially 180 degree rotational symmetry.

In one embodiment, the coaxial transmission line includes a conical section of transmission line of substantially constant impedance and increasing diameter from an input end to an output end, the conical section comprising the outer conductor electrically coupled to the reflecting element at the output end and the inner conductor electrically coupled to the radiating element through the aperture in the reflecting element, wherein the conical section is substantially perpendicular to and concentric with the reflecting element and a coaxial connector, coupled to the input end of the conical section, configured to connect the antenna assembly to its corresponding source of microwave or radio frequency energy.

In one embodiment, the outer conductor has an inner diameter at the output end that is larger than the aperture of the reflecting element, the antenna assembly further comprising a conical dielectric insert conforming to the inner diameter of the outer conductor and the outer diameter of the inner conductor, wherein the conical section of transmission line may be sealed against positive pressure of a medium within the chamber.

In one embodiment, a minimum linear dimension of the chamber is comparable to free-space wavelength at a nominal frequency of operation and a maximum volume of the chamber supports approximately 100 unloaded modes within an operating bandwidth.

In one embodiment, the apparatus further includes the plurality of antenna assemblies disposed upon an inner surface of the second end-cap.

In one embodiment, the plurality of antenna assemblies disposed upon the inner surface of the second end-cap is equal in number to the plurality of antenna assemblies disposed upon the inner surface of the first end-cap, spaced at approximately equal angles around the axis of symmetry of the chamber, and rotated by an angle to minimize intercoupling of antennas.

In one embodiment, the angle is approximately one-half of an angular spacing between adjacent antennas in the plurality of antenna assemblies disposed upon the inner surface of the second end-cap.

In one embodiment, the apparatus further includes a load disposed within the chamber, wherein the load comprises a material that is capable of absorbing energy at the operating frequency or operating frequencies of the microwave or radio frequency field within the chamber, wherein the load is coupled to the plurality of quasi-orthogonal resonant modes and is substantially uniformly irradiated by the microwave or radio frequency field.

In one embodiment, the load is approximately centered at a midplane of the chamber.

In one embodiment, at least one of dimensions of the load is longer than a minimal operating wavelength of the microwave or radio frequency field.

In one embodiment, at least one dimension of the load is comparable to or smaller than the penetration skin depth of the load material at the frequency or frequencies of the microwave or radio frequency field.

BRIEF DESCRIPTION OF THE DRAWINGS

The present invention is illustrated by way of example, and not of limitation, in the figures of the accompanying drawings, in which reference numerals designate like elements and wherein.

DETAILED DESCRIPTION

Figure 1B:
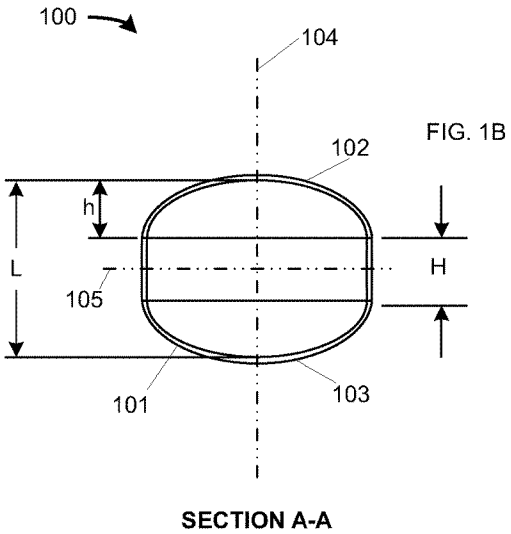
FIGS. 1A-1D illustrate a microwave chamber according to one embodiment.

In the following description, for purposes of explanation, numerous specific details are set forth in order to provide a thorough understanding of the present invention. It will be evident, however, to one skilled in the art that the present invention may be practiced without these specific details. In other instances, well-known circuits, structures and techniques are not shown in detail or are shown in block diagram form in order to avoid unnecessarily obscuring an understanding of this description.

References throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention. In addition, while the invention is described in terms of several embodiments, those skilled in the art will recognize that the invention is not limited to the embodiments described. The embodiments of the invention can be practiced with modification and alteration within the scope of the appended claims. The specification and the drawings are thus to be regarded as illustrative instead of limiting on the invention.

As used herein, the terms "coupled" or "coupling" may refer to direct or indirect connections between elements or components of the embodiments and may be applied to electrical, mechanical and electromagnetic connections.

As used herein, the term "substantially flat" means that a radius of curvature of a surface of the reflecting element is at least 2 times longer than the operating wavelength.

The term "skin depth," used herein, is well known in the art as the characteristic of the penetration depth of electromagnetic irradiation within a material. To achieve better uniformity throughout the entire volume of a load, the radiation must be able to penetrate through the load which implies the load is "thin" as compared to the skin depth. Assuming, for example, that the load material is water and is irradiated at 2.45 GHz, the skin depth of the load material about 1.5 cm.

According to one embodiment of the invention, an apparatus includes a chamber configured to support a plurality of quasi-orthogonal resonant modes and at least one antenna assembly comprising an antenna having a radiating element, wherein (i) the antenna has predominantly linear polarization of radiation defined by a polarization plane, (ii) the radiating element is disposed within the chamber such that the polarization plane is not parallel and not perpendicular to the plane containing a primary axis of the chamber and a central point of the radiating element, and (iii) the antenna is coupled to the chamber through a designated surface of the chamber and coupled to at least one source of microwave or radio frequency energy having an operating frequency and positioned to launch one or more of the plurality of quasi-orthogonal resonant modes to be coupled to a load disposed within the chamber.

Sources of microwave or RF energy are known in the art. Examples are provided to illustrate designs for specific frequencies and/or frequency bands (e.g., magnetrons operating in the frequency band from 2.4 to 2.5 GHz. However, embodiments of the invention are not so limited, and it will be appreciated by those skilled in the art that such designs may be normalized to frequency and/or wavelength and scaled to other operating frequencies or bands of frequencies. Furthermore, it is contemplated that multiple sources operating in different bands may be implemented in the same chamber.

In certain embodiments, the chamber has a plurality of antenna assemblies positioned at an angle such that intercoupling between antennas is minimized. Such angular and spatial positioning can be achieved by mounting antennas on a designated surface of the chamber. If the designated surface of the chamber is substantially flat, angular and spatial positioning can be achieved by directing the antennas during mounting by methods known in the art, e.g., welded fittings. If the designated surface of the chamber is curved, the curvature itself can be employed to achieve the desired angular positioning, Examples of chamber shapes in various embodiments of the invention include an ellipsoid, a spheroid, a sphere, a cylinder having a polygonal or an elliptical cross section and two end-caps, each end-cap being at least one of flat, conical, pyramidal, ellipsoidal, spheroidal, spherical or polyhedron shape, and combinations thereof.

Figure 1D:
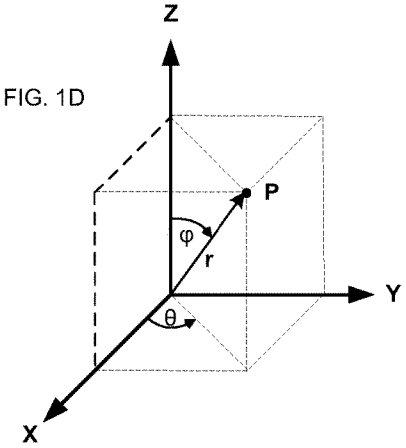
Figure 1A:
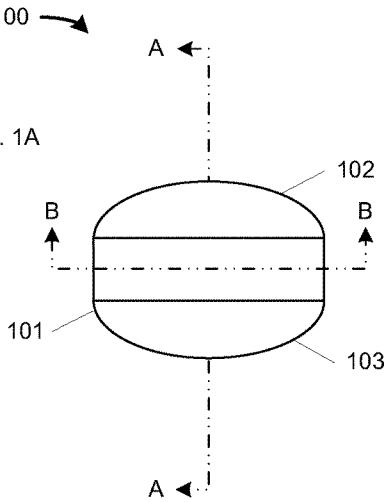
Figure 1C:
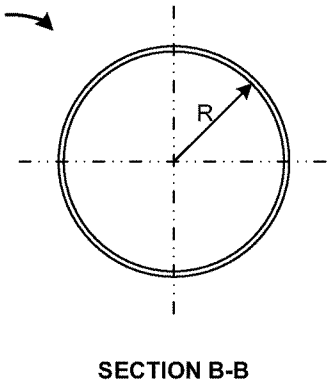

FIGS. 1A-1C illustrate a chamber 100 according to one embodiment of the invention. FIG. 1A is a planar view, FIG. 1B is a view through section A-A of FIG. 1A and FIG. 1C is a view through section B-B of FIG. 1A. FIG. 1D illustrates a coordinate system that can be mapped onto an axis of symmetry 104 of the chamber 100 and a midplane 105 of the chamber 100 and that can be used to express the location of any point P within the chamber or on the interior surfaces of the chamber in terms of rectangular coordinates P(x,y,z) or spherical coordinates P(r,θ,φ). Transformations between the two coordinate systems are well-known in the art. In one embodiment, chamber 100 includes a cylindrical insert ("cylinder") 101, a first end-cap 102 and a second end-cap 103, respectively configured to connect mechanically and electrically with the edges of the cylinder 101 without any substantial discontinuity of the inner surface of the chamber 100 at the junctions of the end-caps and the cylinder. Cylinder 101 may be characterized by an internal radius R and a height H. In the limit, the height H may be reduced to zero, in which case the overall shape of chamber 100 will be reduced to the joined shapes of end-caps 102 and 103. End-caps 102 and 103 may each have the general shape of a partial oblate spheroid generated by the rotation of a semi-ellipse around a semi-major or semi-minor axis of the semi-ellipse, with an internal radius R and internal height h, where h is the minor semi-axis of the ellipse. In various embodiments, the ratio h/R of the end-cap may be selected to be in a range from approximately 0 to approximately 1.0, the lower limit corresponding to a flat plate and the upper limit corresponding to a semi-spherical end-cap.

In one embodiment, the chamber 100 may have a minimum linear dimension that is comparable to the free-space wavelength at a nominal operating frequency of the chamber, and a maximum volume configured to support approximately 100 unloaded resonant modes within the chamber within an operating range of frequencies. An unloaded resonant mode is defined as a mode that is supported by the chamber when there is no load material in the chamber.

It will be understood that the chamber may include multiple ports for adding or removing various substances in accordance with particular applications. For example, the substances can be a liquid, a buffer gas, vapor and particles. Ports are designed to assure negligible loss of microwave or RF energy and would not affect the spectrum of supported modes.

The materials of the cylinder and the end-cap may be selected from conductive materials known in the art to provide strength, thermal stability and sufficient rigidity to resist deformation under pressure that maybe different (higher or less) from the pressure in the exterior and in the load. Such materials may include, but are not limited to aluminum, stainless steel. Brass and also can be coated with non-conducting materials, e.g., dielectrics. While not illustrated, it will be appreciated that electro-mechanical connections between the cylinder and end-caps may be accomplished in many ways, such as a threaded connection, a clamped connection or the like, and may use gaskets to provide pressure sealing. Electrical properties of the connection provide small ohmic and radiative loss compared to that in the load and also provide safety in terms of the electromagnetic environment external to the chamber. Chambers can be made by methods known in the art, such as, for example, press forming, forging, pressure molding, welding, etc.

The internal dimensions of chamber 100 may be selected, based on the desired frequencies of operation of the chamber, to optimize the number of resonant modes supported by the chamber. Resonant modes, or Eigenmodes as they are known in the art, are standing wave patterns that satisfy the boundary conditions imposed by the conducting inner surface of the chamber and all conducting or dielectric bodies, (including coupling elements such as antennas within the chamber). A standing wave field intensity pattern exhibits a spatial variation caused by the interference of incident and reflected waves in the chamber.

Well-known boundary conditions are that the total tangential electric field at the surface of a "good" conductor such as, for example, aluminum, stainless steel and brass is approximately zero. Materials that are intermediate between good and poor conductors and high and low permeability have their own set of well-known boundary conditions relating to continuities and discontinuities of the electric and magnetic fields across dielectric-metal boundaries such as the air-chamber boundary here.

These boundary conditions, along with the dimensions of the chamber 100 can be modeled using commercially available simulation programs to identify most or all of the resonant modes of the chamber 100 and their sensitivity to frequency. The goal is to choose chamber dimensions and an arrangement of internal conducting or dielectric bodies that support multiple resonant modes having significantly reduced Q-factor due to coupling to the load and to determine the locations of microwave radiators (antennas) within the chamber that couple to these modes and the best location for a load that is intended to absorb the energy. Q-factor is a term of art that refers to the energy loss rate of a resonant mode. For purposes of the present applications, strong coupling implies a loss rate such that the mode bandwidth is equal to or greater than the maximum frequency range of the source(s) A properly located and oriented antenna operating at a frequency anywhere within the bandwidth of the mode can excite the mode.

The approach disclosed herein is based on a constrained multimode operating regime. The regime imposes both lower and upper limits on the chambers dimensions and volume. The minimum chamber dimensions are chosen to support multimode operation rather than single-mode. That is, the minimum dimension is constrained to above a wavelength to have a multi-node pattern in any dimension. The maximum dimension is limited by two requirements: preventing far-field Fraunhofer diffraction effects (otherwise known as optical diffraction) and limiting the number of modes that can be supported by the chamber with antennas.

The diffraction limit is determined by the maximum Fresnel number $N_f=2D^2/L\lambda$, where $D=D_{RAD}$ is the maximum dimension of the radiating element, L is the distance to the opposite cavity wall from the radiating element along its normal, and λ is the wavelength of the electromagnetic radiation. Optical propagation with Fraunhofer diffraction occurs at $N_f<1$, which defines the far-field zone. Experiments and simulations performed by the inventors have found that the antenna configurations disclosed herein provide efficient performance when the $N_f$ is within the range 0.15-1.5.

On the other hand, when the number of modes within the source passband(s) is too large, then a large fraction of them can couple easily to the antenna(s), but not necessarily to the load, resulting in significant reflections that generate parasitic, high-Q modes. One type of such parasitic, high-Q modes are known as whistling gallery modes. In general, the number of modes in a closed cavity is proportional to the modal spectral density given as follows (see, e.g., R. Courant and D. Gilbert, *Methods of Mathematical Physics,* Vol. 1, (Gosteckhizdat, 1933)):

$$\left.\frac{\Delta N}{\Delta\omega}\right|_{3D} \approx \frac{V\omega^2}{2\pi^2 c^3},$$

where V is the cavity volume, and ΔN is the number of eigenmodes per spectrum width Δω, ω=2πf is the radian frequency, and c is the speed of light. Experiments and simulations performed by the inventors have found that the number of unloaded modes (i.e., modes in the absence of a load) is limited to about one hundred to provide for operation of the magnetron. For example, for a 75 cm diameter spherical cavity, the number of unloaded eigenmodes is about 70 within the typical 2.4-2.5 GHz passband. This electrically large cavity (in terms of wavelengths) with a load and antennae requires special efforts in matching and tuning to put it into a stable mode of operation because of too many (more than a few) higher-Q modes having reduced intensity in the vicinity of the load compared to other, lower-Q modes.

In some embodiments of the present invention, reduced coupling between independent sources and its corresponding power couplers is achieved by using independent microwave or RF sources for each antenna. These sources may operate at slightly different frequencies in one frequency band or in entirely different frequency bands. For example, two microwave sources designed for nominal operation near 2.45 GHz, the center of the industrial/commercial microwave oven band (1 GHz equals one billion cycles per second), but actually operating at 2.40 GHz and 2.50 GHz respectively, due to manufacturing tolerances and frequency drift (e.g., from temperature effects), will have a difference frequency of 100 MHz.

In practice, it is not possible to obtain perfect coupling of the modes to the load in a multimode chamber and decoupling between multiple antennas in the closed chamber. One aspect of the present invention is a multimode, non-rectilinear chamber coupled to multiple antennas and an internal load. This configuration provides effective coupling of the antennas with the load and reduced intercoupling due not only to certain orientations of the polarization of each antenna radiation, but also the location of the antennas with respect to spatial extremes of the polarized 3D standing wave pattern The generalized combination of up to all six degrees of mechanical freedom (3D rotational, and 3D translational) provides low levels of cross-coupling and interference and better efficiency and uniformity of energy delivery to the load than conventional designs.

It will be understood that the shape of the radiating element can be symmetrical or non-symmetrical. In certain embodiments, each antenna assembly is configured to have mechanical degrees of freedom which include at least one of (i) rotation about a normal direction to the primary plane of the radiating element, (ii) an angle of inclination of the normal direction to the primary plane of the radiating element relative to an axis of symmetry of the chamber, (iii) a radial distance from the axis of symmetry of the chamber, (iii) an azimuthal rotation around the axis of symmetry of the chamber, and (iv) a distance between a plane of the radiating element and the designated surface of the chamber.

Figure 2B:
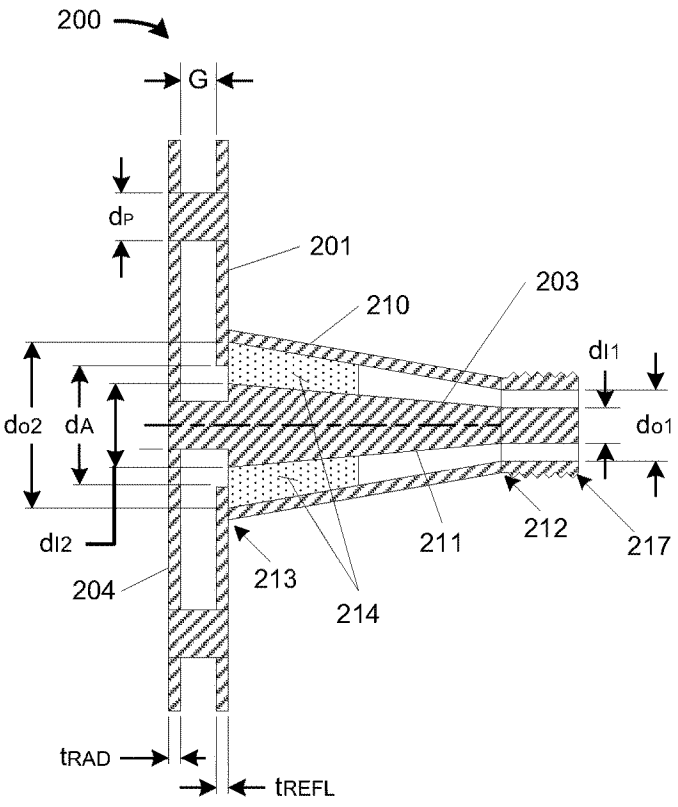
FIG. 2B is a cross-sectional view of the antenna assembly of FIG. 2A.
Figure 2A:
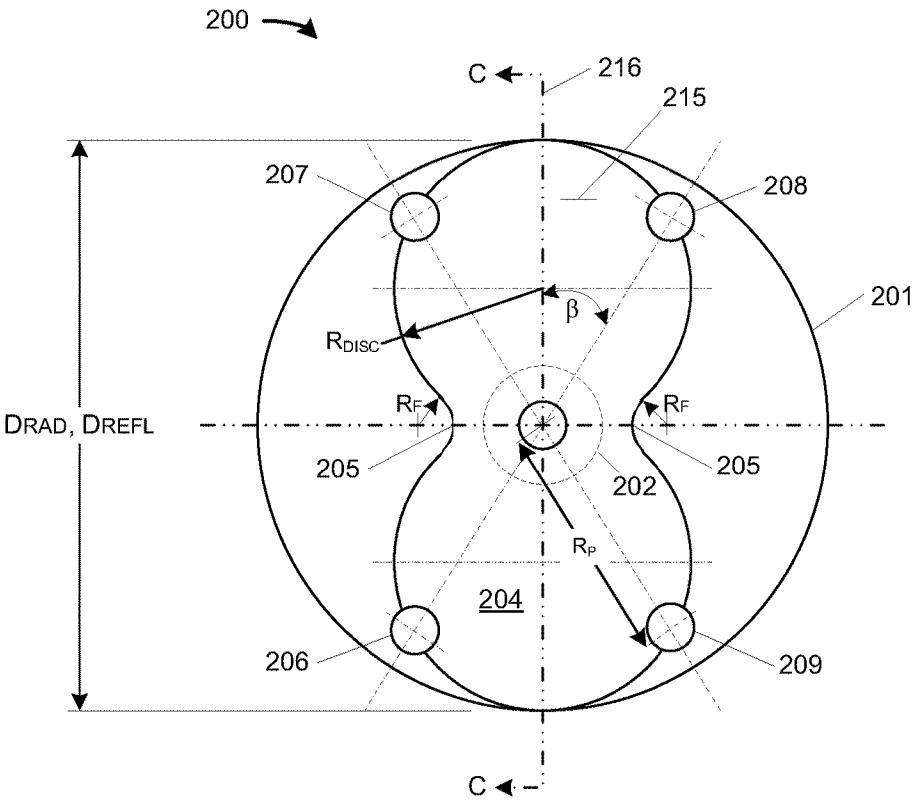
FIG. 2A is a plan view illustrating an antenna assembly according to one embodiment.

FIGS. 2A and 2B illustrate an antenna assembly 200 in one or more embodiments of the present invention. FIG. 2A is a plane view of the radiating surface of antenna 200 and FIG. 2B is a cross-sectional view through section C-C of FIG. 2A. Antenna assembly 200 includes a conductive reflecting element 201 having a defined shape with a minimum dimension that is less than or equal to a maximum dimension of the radiating element described below. In one embodiment, as illustrated in FIGS. 2! And 2B, the reflecting element comprises a substantially flat surface of diameter $D_{REFL}$ and thickness $t_{REFL}$, having a substantially circular aperture 202 of diameter $d_A$, substantially concentric with the axis of symmetry 203 of the transmission line.

Figure 8A:
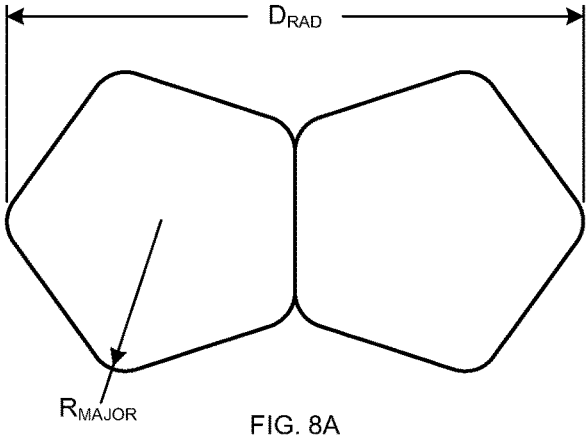
FIGS. 8A-8C illustrate several embodiments of a radiator.
Figure 8B:
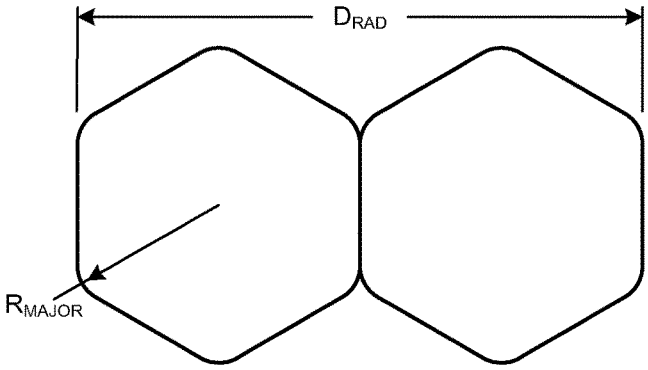
Figure 8C:
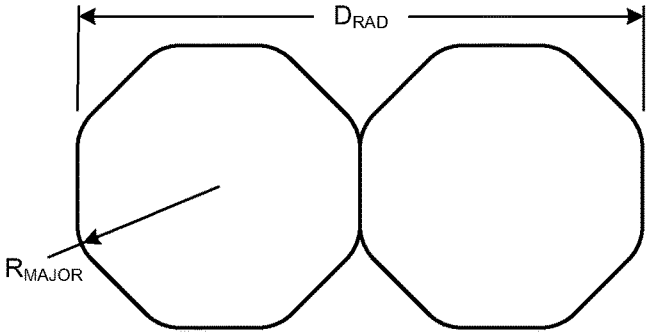

Antenna assembly 200 also includes a conductive radiating element 204, having a maximum dimension $D_{RAD}$ and thickness $t_{RAD}$ substantially parallel to the reflecting element 201 and spaced from the reflecting element 201 by a gap G. As illustrated in FIG. 2A, in one embodiment, the radiating element 204 approximates two overlapping discs, each of radius $R_{DISC}$, with fillets 205 of radius $R_F$. Major dimension $D_{RAD}$ is approximately equal to $D_{REFL}$ in the illustrated embodiment. In other embodiments, radiating element 204 may have a major dimension $D_{RAD}$ that is less than $D_{REFL}$. In other embodiments, radiating element 204 may take the shape of a pair of simply-connected geometric figures (i.e., where any two-points on the perimeter of the geometric figure can be connected with a straight line that does not cross the perimeter), having a coplanar surface, where the radiating element 204 has substantially 180 degree rotational symmetry around an axis of symmetry collinear with the axis of symmetry 203 of the transmission line. FIGS. 8A-8C illustrate examples of such radiating elements for the case of a pentagon, a hexagon and an octagon, respectively, where the dimension $R_{DISC}$ is replaced with the dimension $R_{MAJOR}$. In one embodiment, the vertices of the simple geometric shapes are rounded. In other embodiments, the vertices may be point vertices.

Antenna assembly 200 may also include one or more conductive pins, such as pins 206-209, disposed between the radiating element 201 and the reflecting element 204. Any single pin may be used and any combination of pins may be used in alternative embodiments for 2-pin, 3-pin and 4-pin combinations. The pins 206-209 may be approximately centered on the perimeter of the radiating element 204, at a distance $R_P$ from the axis 203, offset at an angle β from the major axis 216 of the radiating element 204. Selection of the number and location of pins may be determined empirically as a function of the shape of chamber 100. The values of $R_P$, β and pin diameter $d_P$ may be selected empirically or through simulation using commercially available software as described above, to control the polarization and impedance of the antenna assembly 200.

Antenna assembly 200 may also include a coaxial transmission line having an outer conductor 210 electrically and mechanically connected to the reflecting element 201 and an inner conductor 211 electrically and mechanically connected to the radiating element 204 through the aperture 202. The inner conductor 211 may have a stepped diameter, as illustrated in FIG. 2B, to control impedance as is known in the art. In one embodiment, the coaxial transmission line may include a conical section of substantially constant impedance and increasing in diameter from an input end 212 to an output end 213, where the conical section includes the outer conductor 210, coupled to the reflecting element 201, and the inner conductor 211 coupled to the radiating element 204, and where the conical section is substantially perpendicular to and concentric with the reflecting element 201. The coaxial transmission line may also include a straight threaded coaxial section 217 intended to mate with a corresponding coaxial connector on a waveguide coupler/tuner configured to couple the antenna assembly 200 with a source.

In one embodiment, the outer conductor 210 of the conical section has an inner diameter $d_{O2}$ at the output end 213 that is greater than the diameter $d_A$ of the aperture 202 of the reflecting element 201, where the antenna assembly 200 further includes a conical dielectric insert 214 conforming to the inner diameter of the outer conductor 210 and the outer diameter of the inner conductor 203. The dielectric insert 214 can be sealed by, for example, being compressed by the reflecting element and the conical section against positive pressure in the chamber.

Figure 4A:
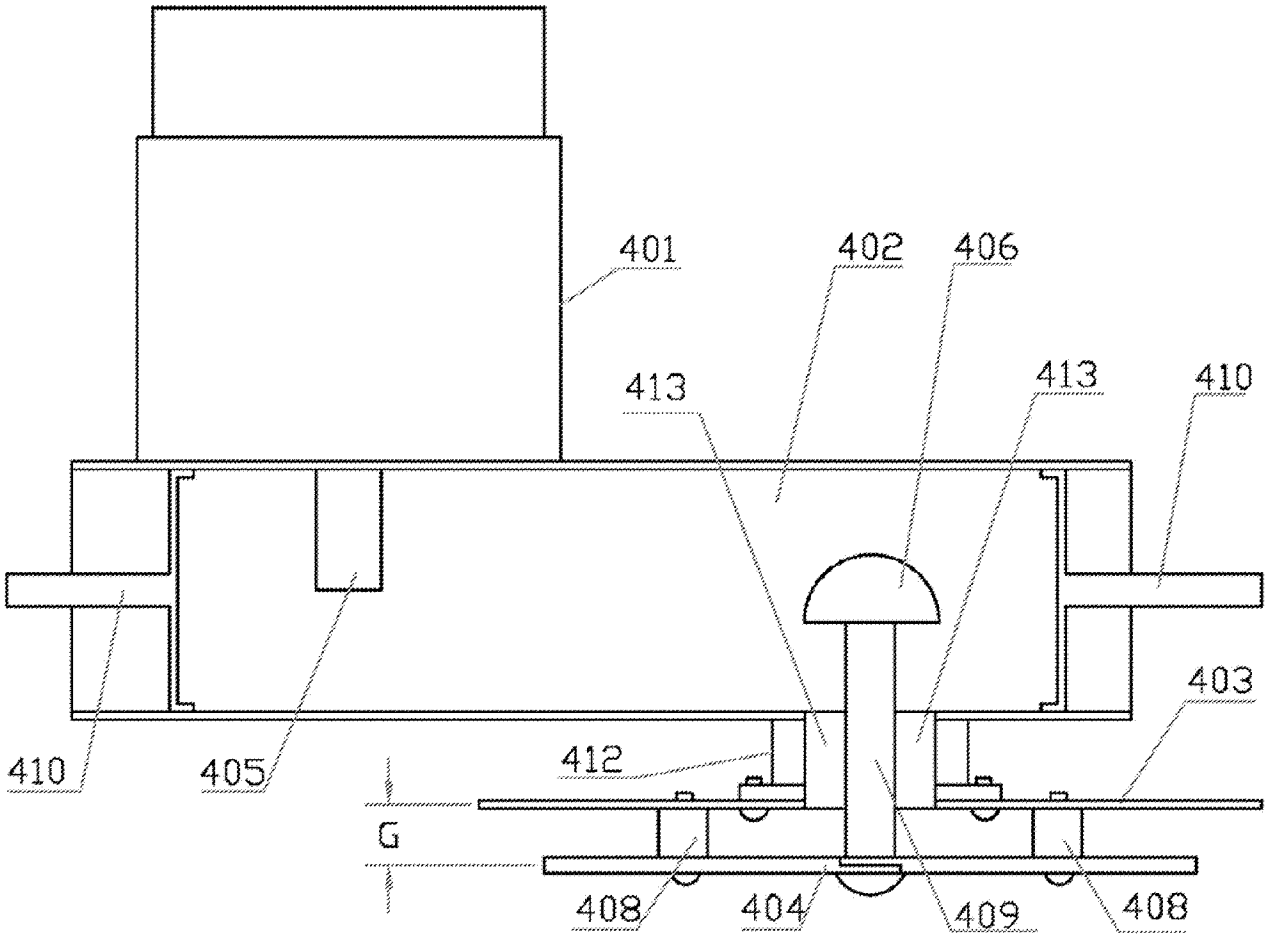
FIG. 4A Prior Art
FIG. 4A is a cross-sectional view of an antenna assembly coupled to a magnetron according to one embodiment (previously presented in U.S. patent application Ser. No. 12/313,806)
Figure 4B:
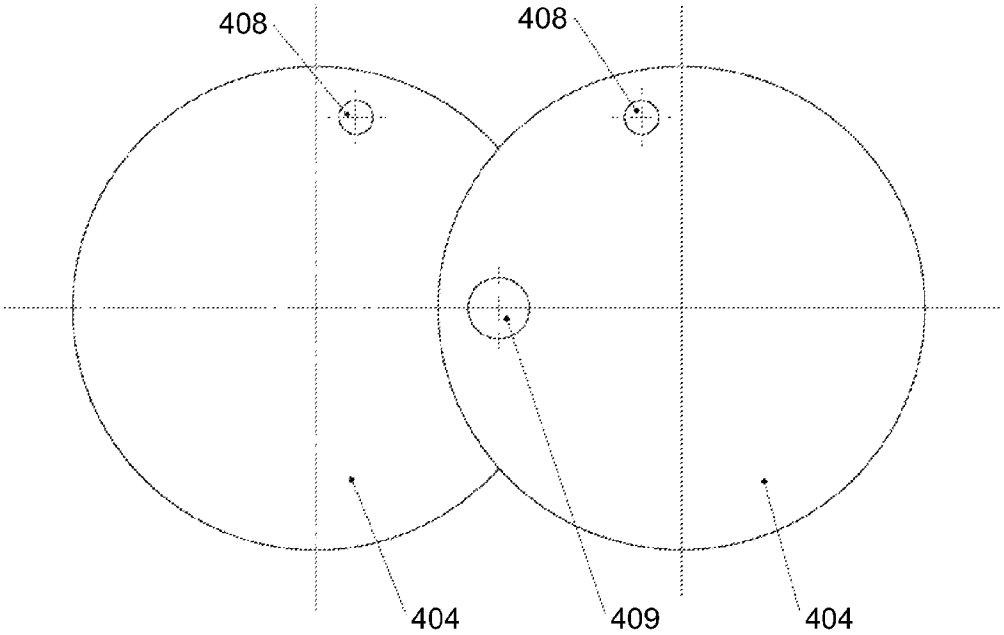
FIG. 4B Prior Art
FIG. 4B is a plan view illustrating a radiating element of an antenna illustrated in FIG. 4A (previously presented in U.S. patent application Ser. No. 12/313,806)

FIGS. 4A and 4B illustrate one embodiment of an antenna assembly coupled to a source of energy, such as a magnetron. In FIG. 4A, the outer conductor 412 of a coaxial transmission line connects a reflecting element 403 and the waveguide 402. As shown in FIG. 4*a*, the longest dimension of the radiating element 404 may be smaller than the diameter of the reflecting element 403. The radiating element has two pins 408 defining the gap G between the reflecting element 403 and the radiating element 404. The magnetron 401 is coupled to a waveguide 402 using the coupling element of the magnetron 405. The tuning plungers 410 are provided to adjust the electrical distance between the end-walls of the waveguide 402. A coupling element 406 is electrically connected to the radiating element 403 by the inner conductor 409 of the coaxial connector. A coaxial space 413 between the inner conductor 409 and the outer conductor 412 may be filled with a gas, liquid, solid or particulate dielectric material.

Figure 7:
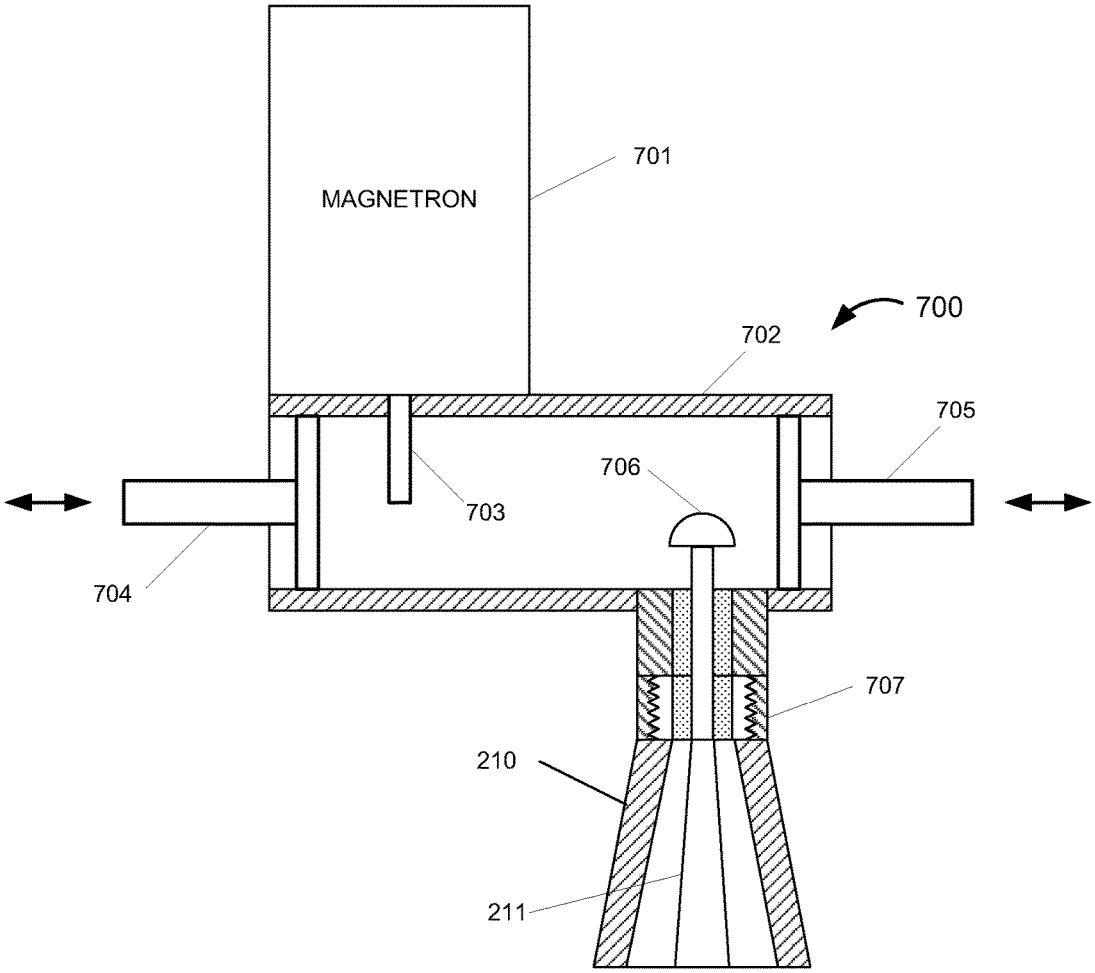
FIG. 7 illustrates an conical coaxial transmission line connected to a waveguide and a magnetron according to one embodiment.

FIG. 7 illustrates an assembly 700 including a source of microwave energy, a magnetron 701, coupled to a waveguide 702 coupled to coupling element 703 of the magnetron 701. The waveguide 702 is configured to match the source impedance of the magnetron 701 to the input impedance of the antenna assembly 200 with tuning plungers 704 and 705 to adjust the electrical distance between the end-walls of the waveguide 702 and a coaxial coupling element 706. The waveguide may also include a coaxial connector 707 to mate it with the coaxial transmission line (outer conductor 210 and inner conductor 211) of the antenna assembly 200. When connected to an antenna assembly, the waveguide is tuned to produce a matched networks. The tuning procedures and matching networks are well-known in the art and art not described here in any greater detail.

Figure 5A:
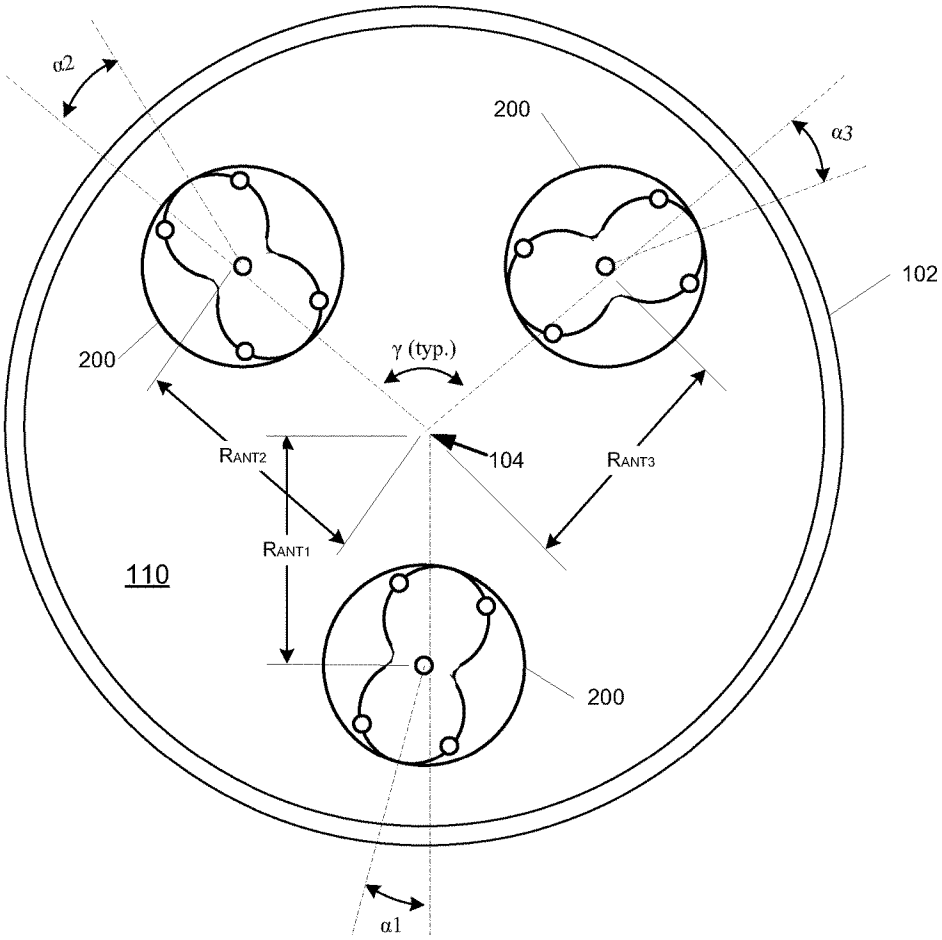
FIG. 5A is an axial view illustrating a chamber with an array of antenna assemblies according to one embodiment.
Figure 5B:
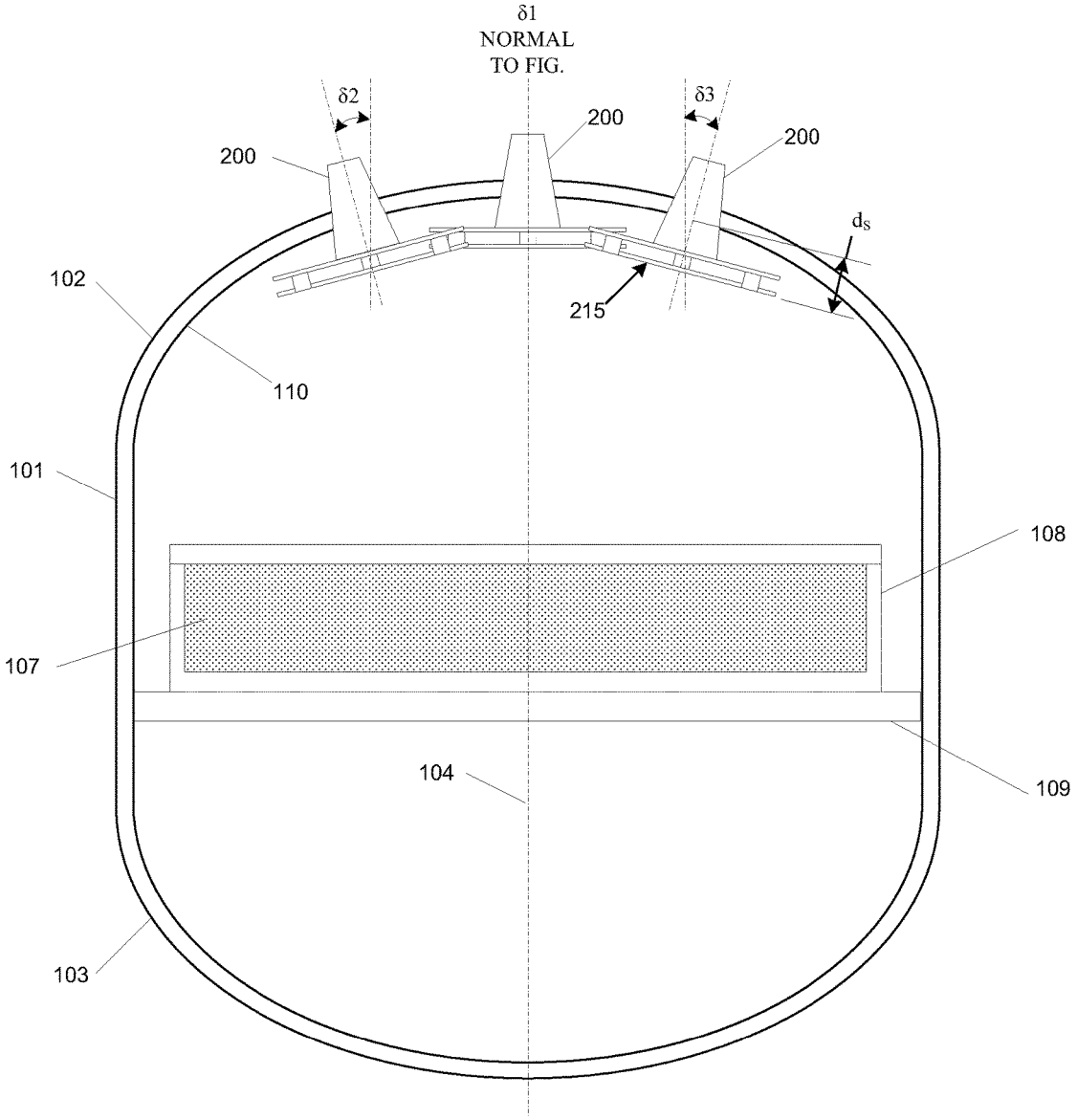
FIG. 5B is a partial cross-sectional diagram illustrating a disposition of three radiating elements in a chamber according to another embodiment.

FIGS. 5A and 5B illustrate, respectively, axial and partial cross-sectional views of a chamber according to one embodiment. FIG. 5A illustrates three antenna assemblies 200 disposed upon the inner surface 110 of end-cap 102, where the geometric centers of the three antenna assemblies are located at radial distances $R_{ANT1}$, $R_{ANT2}$ and $R_{ANT3}$ from the axis of symmetry 104, and spaced at approximately equal angles γ around the axis of symmetry 104. The rotational orientation of each antenna assembly may be defined by a respective angle α(α1, α2 and α3), the angle formed by a line subtending the maximum dimension of each radiating element with a radial line extending from the axis of symmetry 104 through the geometric center of each antenna.

FIG. 5B illustrates a side view of the antenna configuration of FIG. 5A, where the antenna assemblies 200, the chamber 100, and a load 107 are shown. The antenna assemblies are coupled through the end-cap 102 by their respective conical transmission lines to external sources of microwave or RF energy (not shown). In other embodiments, the conical sections may be replaced with or extended with constant diameter sections of coaxial line. In other embodiments, the conical sections may be replaced with or extended with constant diameter sections of coaxial line.

A respective tilt angle δ (δ1, δ2, and δ3) is defined for each antenna assembly 200 as the angle formed by the axis of symmetry 203 of each antenna assembly with a line parallel to the axis of symmetry 104 of the chamber. A respective distance ds (ds1, ds2 and ds) is defined for each antenna assembly 200 as the distance from the planar radiating surface 215 of each antenna assembly 200 to a tangent plane at the inner surface 110 of the end-cap 102, where the axis of symmetry 203 of each antenna intersects the inner surface 110 of the end-cap 102, is normal to the tangent plane, and where the radiating surfaces 215 are parallel to the respective tangent plane.

Accordingly, each antenna assembly 200 has mechanical degrees of freedom comprising at least one of (i) rotation about the normal direction 203 to the primary plane 215 of the radiating element, (ii) an angle of inclination δ of the normal direction to the primary plane 215 of the radiating element relative to an axis of symmetry 104 of the chamber, (iii) a radial distance $R_{ANT}$ from the axis of symmetry 104 of the chamber, (iii) an azimuthal rotation α around the axis of symmetry 104 of the chamber, and (iv) a distance ds between a plane of the radiating element 215 and the inner surface 110 of the end-cap 102.

Tuning the apparatus comprises adjustment of the respective parameters $R_{ANT}$, α, δ and ds for each antenna assembly to maximize the efficiency and uniformity of energy delivery to the load 107 within the chamber. The mechanical design features required to implement these degrees of freedom will be understood by those of skill in the art and are not described in detail here.

Figure 6:
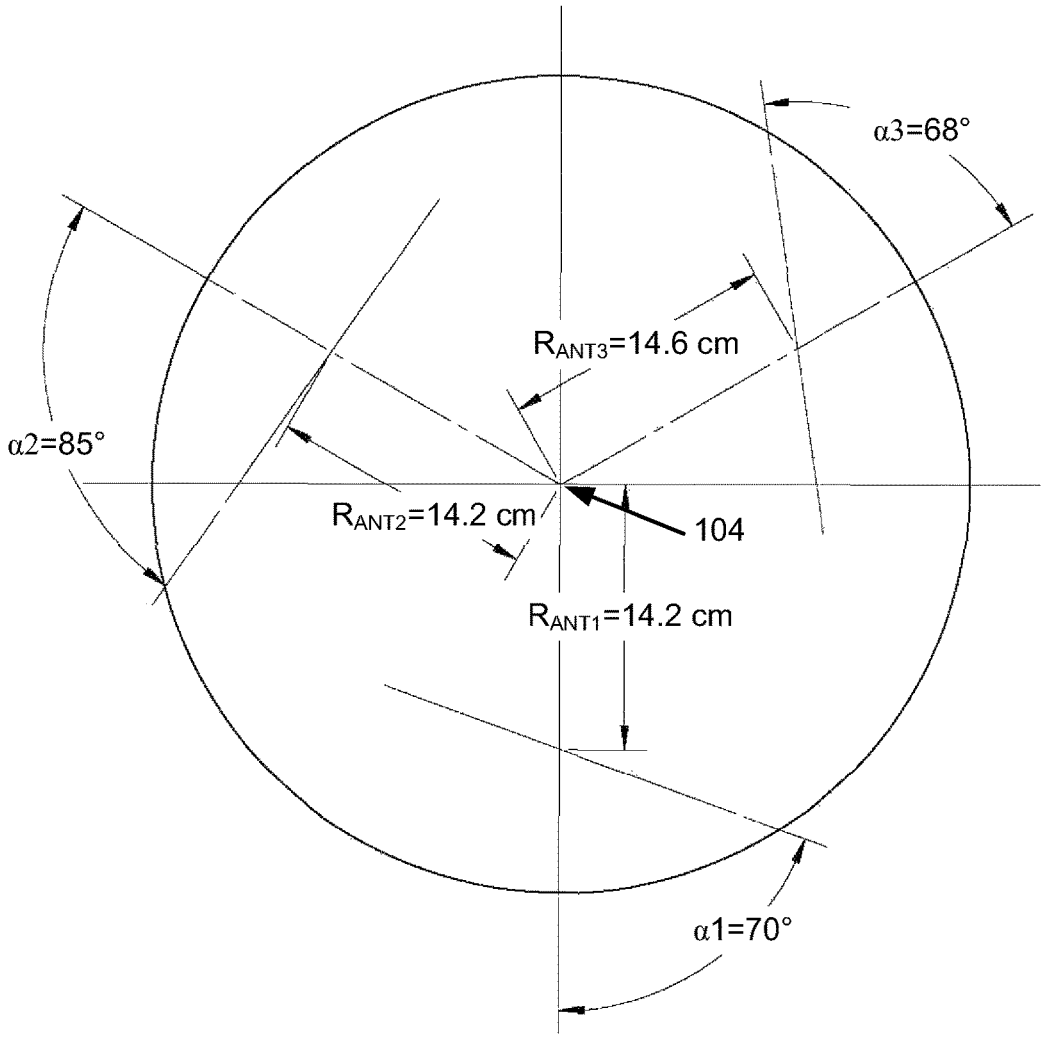
FIG. 6 illustrates an exemplary disposition of three radiating elements of FIG. 6A in one embodiment.

FIG. 6 is a exemplary representation of the antenna configuration illustrated in FIG. 5A after tuning to maximize efficiency and power transfer within a chamber designed for operation in the 2.4 GHz to 2.5 GHz band with a nominal operating frequency of 2.45 GHZ. As seen in FIG. 6, radiating elements are disposed at angles 70 degrees, 68 degrees and 85 degrees, respectively, and the distances between the geometrical center of each radiating element and the axis of symmetry the chamber are 14.2 cm, 14.6 cm and 14.2 cm, respectively. While not illustrated in FIG. 6, the corresponding tilt angles δ1, δ2, and δ3 are all approximately 22.5 degrees, and the corresponding distances ds1, ds2 and ds3 are all approximately 3 cm.

Figure 9:
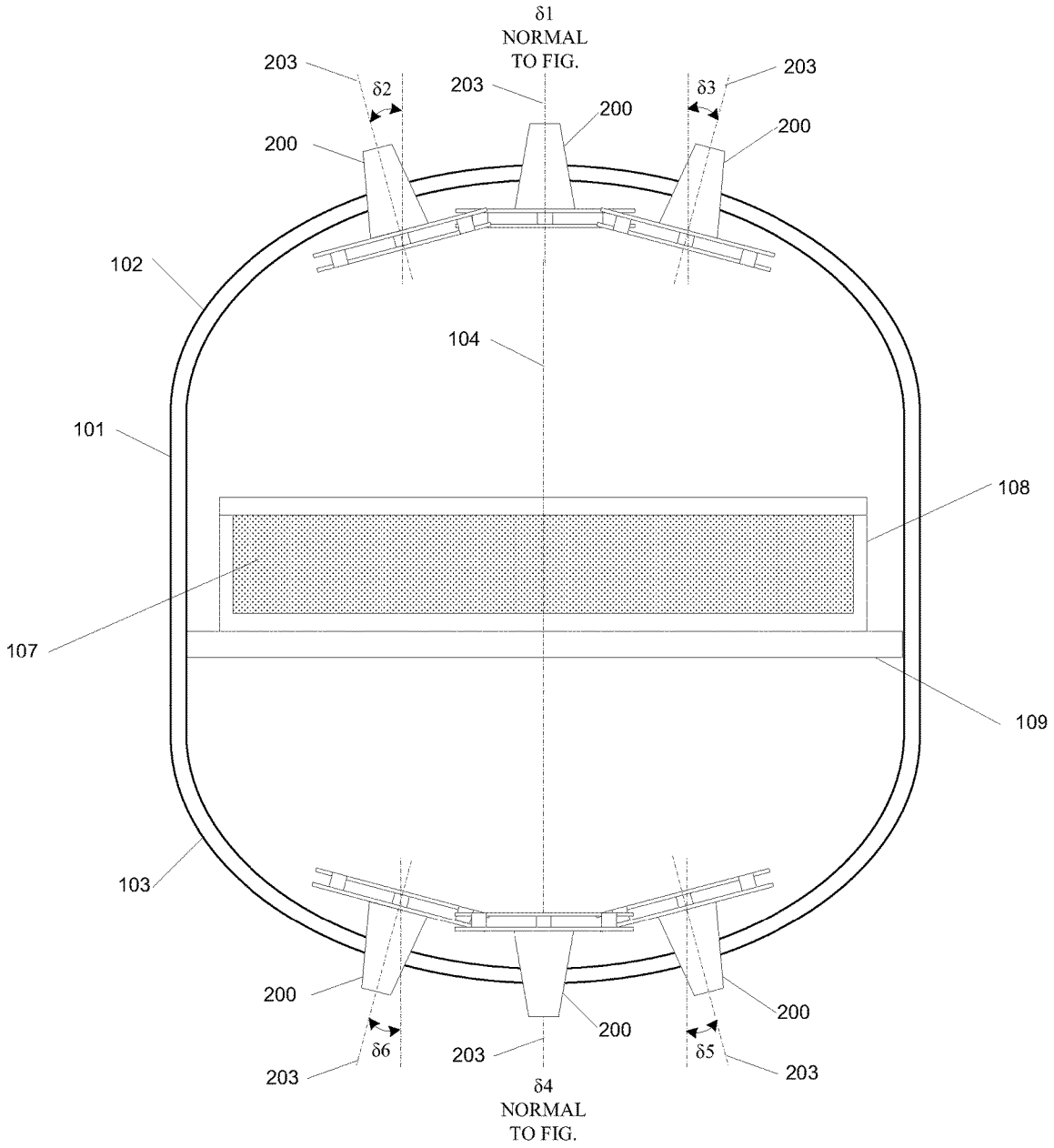
FIG. 9 is a partial cross-section illustrating a chamber with six antenna assemblies according to one embodiment.
Figure 10:
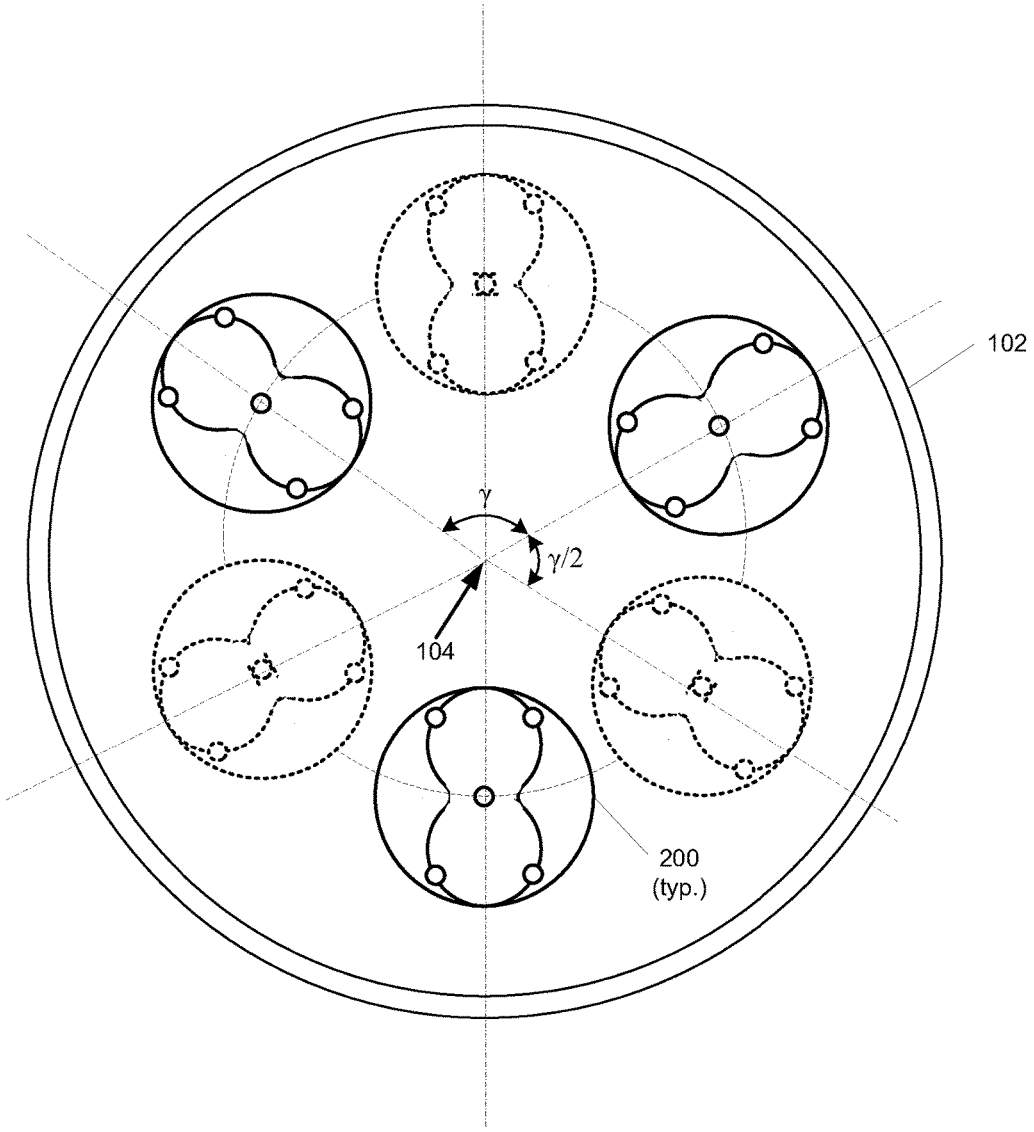
FIG. 10 is an axial view illustrating relative positions of antenna assemblies in one embodiment.

FIG. 9 illustrates an alternative embodiment wherein, in addition to a the first group of the antenna assemblies disposed upon the inner surface of the first end-cap 102, a second group of antenna assemblies, equal in number to the first group, is disposed upon the inner surface of the second end-cap 103. In certain embodiments, the second group is spaced at equal angles γ around the axis of symmetry 104 of the chamber 100, but is rotated through an angle γ/2 relative to the first group. FIG. 10 illustrates an axial view of an exemplary 6-antenna configuration wherein the locations of the three antennas disposed on the first end-cap are superimposed on the locations of the three antennas disposed on the second end-cap.

While exemplary embodiments of the present invention have been described in detail for groups of three antennas per end-cap, the invention is not so limited and contemplates the use of 1, 2, 4, 5, 6 or more antennas per end-cap applying the general design principles described herein.

TABLES I-III, below, summarize configurations and experimental results for several different embodiments of the invention, where dimensions are indicated for a specific application and normalized in terms of approximate wavelength.

In TABLES I-III, measurements of uniformity of energy density conform with IEC 60705, "Household Microwave Ovens: Method for Measuring Performance," where a standard load comprising one liter of water in a flat cylindrical distribution with individually measured water cells is profiled for temperature changes due to energy absorption.

TABLE I summarizes an exemplary configuration and results for a chamber as illustrated in FIG. 5, with 3 two-pin antenna assemblies similar to that shown in FIGS. 2A and 2B, with a one liter water load placed into a Pyrex vessel with a 1.5 cm water level. All three antenna radiating elements are inclined in the polar direction by 22.5° (angular coordinate $\phi$ in FIG. 1D) relative to the chamber axis 104. The angles $\alpha_1$, $\alpha_2$, $\alpha_3$ describe the angular rotation of each antenna assembly about their respective axis 203 from the original orientation when the maximum dimension of the radiating element lies in the plane containing the chamber axis 104 and axis 203. The mutual angle $\gamma$ between antennas is defined as the difference in the $\theta$ coordinates of FIG. 1D.

TABLE II summarizes an exemplary configuration and results for a chamber as illustrated in FIG. 5, as for TABLE I, with 3 three-pin antenna assemblies.

TABLE III summarizes an exemplary configuration and results for a chamber as illustrated in FIG. 5, as for TABLE I, with 3 four-pin antenna assemblies.

TABLE I

| | 2-PIN | |
|---|---|---|
| PARAMETER | cm | ~λ |
| L | 45.4 | 3.72 |
| H | 9.65 | 0.79 |
| h | 11 | 0.9 |
| R | 22 | 1.8 |
| $d_P$ | 0.5 | .04 |
| $d_A$ | 3.2 | 0.26 |
| $D_{RAD}$ | 12.52 | 1.03 |
| $D_{REFL}$ | 14 | 1.15 |
| $R_{DISK}$ | 3.45 | 0.283 |
| $R_P$ | 4.74 | 0.39 |
| $\beta$ | 27° | |
| $\gamma$ | 120° | |
| $R_{ANT}$ | 13.5 | 1.1 |
| $\alpha_1$ | 262° | |
| $\alpha_2$ | 175° | |
| $\alpha_3$ | 133° | |
| $d_S$ | 3.03 | |
| $t_{RAD}$ | 0.4 | .03 |
| $t_{REFL}$ | 0.3 | .02 |
| G | 0.7 | .057 |
| Peak Total efficiency | 97% | |
| Total efficiency averaged in the 2.4-2.5 GHz band | 84% | |
| Uniformity measured with standard procedure | 93-95% | |

TABLE II

| | 3-PIN | |
|---|---|---|
| PARAMETER | cm | ~λ |
| $d_P$ | 0.5 | .04 |
| $d_A$ | 3.2 | 0.26 |
| $D_{RAD}$ | 14.7 | 1.2 |
| $D_{REFL}$ | 14 | 1.14 |
| $R_{DISK}$ | 3.92 | .32 |

TABLE II-continued

| | 3-PIN | |
|---|---|---|
| PARAMETER | cm | ~λ |
| $R_P$ | 4.92 | 0.4 |
| $\beta$ | 33.2° | |
| $t_{RAD}$ | 0.4 | .03 |
| $t_{REFL}$ | 0.3 | .02 |
| G | 1.06. | .086 |

TABLE III

| | 4-PIN | |
|---|---|---|
| PARAMETER | cm | ~λ |
| $d_P$ | 0.5 | .04 |
| $d_A$ | 3.2 | 0.26 |
| $D_{RAD}$ | 14 | 1.14 |
| $D_{REFL}$ | 14 | 1.14 |
| $R_{DISK}$ | 3.8 | .32 |
| $R_P$ | 4.9 | 0.4 |
| $\beta$ | 33 | |
| $t_{RAD}$ | 0.4 | .03 |
| $t_{REFL}$ | 0.3 | .02 |
| G | 1.2 | .10 |

Figure 3B:
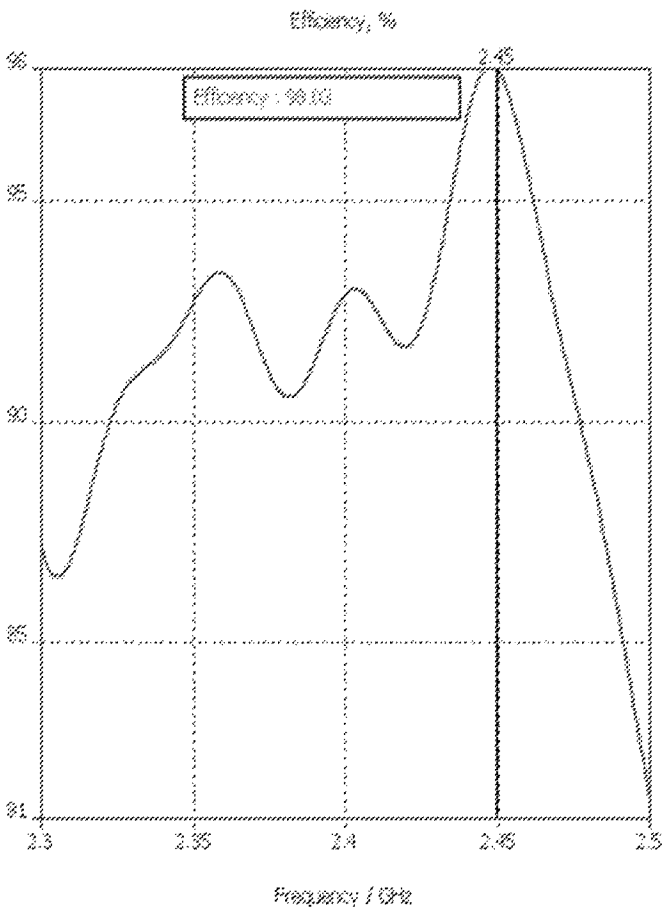
FIGS. 3A and 3B are graphs illustrating performance of a microwave chamber according to several antenna embodiments.
Figure 3A:
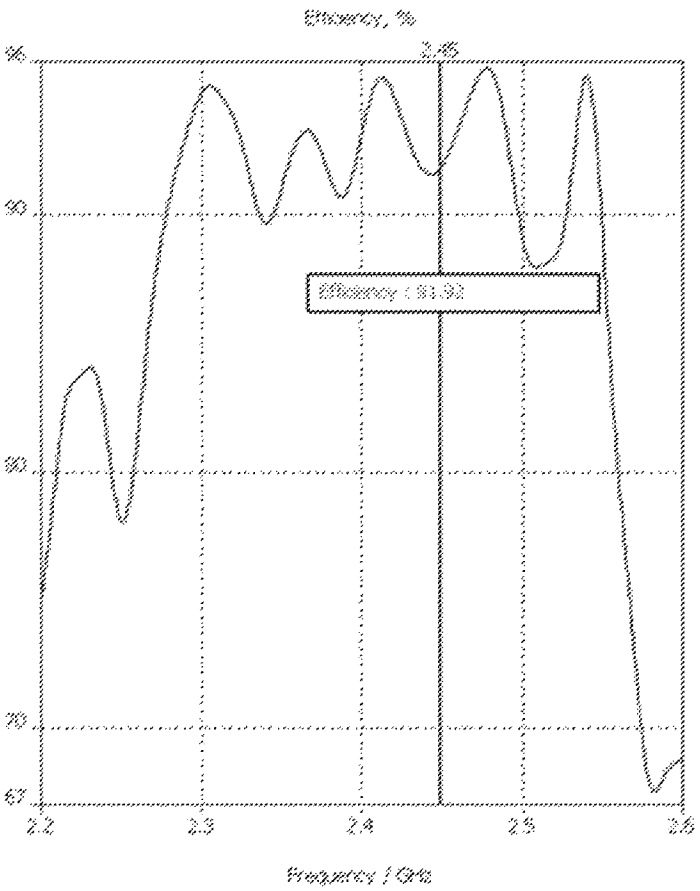

FIGS. 3A and 3B are graphs illustrating the efficiency of a microwave chamber according to the simulation of two exemplary embodiments. FIG. 3A is the simulation result for a spheroidal-cylindrical chamber with H=17.7 cm, L=39.6 cm, R=21.9 cm and h=R/2, loaded with a 1 liter of water to a depth of 1.5 cm in a Pyrex cylindrical vessel with a metal stirrer. The vessel is covered by a Teflon lid. The chamber is energized with three 2-pin antennas. Antenna positions: Rant=11.7 cm, $\delta_1=\delta_2=\delta_3=17.5°$, ds1=ds2=ds3=2.51 cm, and $\alpha_1=158°$, $\alpha_2=160°$, $\alpha_3=175°$. The chamber heights are. In FIG. 3B, all the parameters are the same, except that the H=22.8 cm, L=44.7 cm.

While the invention has been shown and described with respect to specific embodiments, it will be understood by those skilled in the art that various changes and modifications may be made without departing from the spirit and scope of the invention as defined in the following claims.

What we claim is:

1. An apparatus, comprising:

a chamber configured to support a plurality of quasi-orthogonal resonant modes; and at least one antenna assembly comprising an antenna having a radiating element, wherein (i) the antenna has predominantly linear polarization of radiation defined by a polarization plane, (ii) the radiating element is disposed within the chamber such that the polarization plane is not parallel and not perpendicular to a plane containing a primary axis of the chamber and a central point of the radiating element, and (iii) the antenna is coupled to the chamber through a designated surface of the chamber and coupled to at least one source of microwave or radio frequency energy having an operating frequency and positioned to launch one or more of the plurality of quasi-orthogonal resonant modes to be coupled to a load disposed within the chamber wherein the at least one antenna assembly further comprises:

a coaxial transmission line having an outer conductor and an inner conductor;

a reflecting element comprising a body having (i) a defined shape with a minimum dimension comparable to the radiating element maximum dimension, (ii) a substantially flat surface facing the radiating element, and (iii) an aperture, wherein the reflecting element is electrically connected to the outer conductor of the coaxial transmission line;

wherein the radiating element is electrically connected to the inner conductor of the coaxial transmission line, the radiating element substantially parallel to the substantially flat surface of the reflecting element and spaced from the substantially flat surface of the reflecting element by a gap, the radiating, element comprising a single substantially planar body or a multipart body comprising a combination of substantially planar bodies approximating one or more simply-connected geometric figures having a primary plane; and one or more conductive pins disposed between the radiating element and the reflecting element, the one or more conductive pins electrically bridging the gap between the reflecting element and the radiating element and disposed in proximity to a perimeter of the radiating element, wherein impedance and polarization of the antenna assembly are controlled.

2. The apparatus of claim 1, wherein the apparatus comprises a plurality of antenna assemblies wherein each antenna is coupled to the chamber through the designated surface of the chamber and wherein intercoupling between antennas is minimized.

3. The apparatus of claim 1, wherein an antenna assembly is configured to have mechanical degrees of freedom comprising at least one of (i) rotation about a normal direction to the primary plane of the radiating element, (ii) an angle of inclination of the normal direction to the primary plane of the radiating element relative to an axis of symmetry of the chamber, (iii) a radial distance from the axis of symmetry of the chamber, (iv) an azimuthal rotation around the axis of symmetry of the chamber, and (v) a distance between a plane of the radiating element and the designated surface of the chamber.

4. The apparatus of claim 1, wherein the designated surface of the chamber comprises at least one substantially planar surface.

5. The apparatus of claim 1, wherein the designated surface of the chamber comprises at least one partially curved surface.

6. The apparatus of claim 3, wherein the chamber has a shape selected from the group consisting of an ellipsoid, a spheroid, a sphere, a cylinder having (i) a polygonal or an elliptical cross section and (ii) two end-caps, each end-cap being at least one of flat, conical, pyramidal, ellipsoidal, spheroidal, spherical or polyhedron shape, and a combination thereof.

7. The apparatus of claim 1, wherein the designated surface of the chamber comprises at least one partially curved surface in a shape of a first end-cap and a second end-cap, each end-cap comprises one-half of an oblate spheroid and is interconnected with a cylindrical insert along matching edges.

8. The apparatus of claim 7, comprising a plurality of antenna assemblies having two or more antennas disposed upon an inner surface of the first end-cap and spaced at approximately equal angles around an axis of symmetry of the chamber.

9. The apparatus of claim 1, wherein the plane of the radiating element is substantially parallel to a tangent plane at the intersection of a normal direction to the plane of the radiating element through a geometric center of the radiating element and the inner surface of the first end-cap.

10. The apparatus of claim 1, wherein the radiating element comprises two or more simply-connected geometric figures forming a coplanar surface and wherein the radiating element has substantially 180 degree rotational symmetry.

11. The apparatus of claim 1, wherein the coaxial transmission line comprises:

a conical section of transmission line of substantially constant impedance and increasing diameter from an input end to an output end, the conical section comprising the outer conductor electrically coupled to the reflecting element at the output end and the inner conductor electrically coupled to the radiating element through the aperture in the reflecting element, wherein the conical section is substantially perpendicular to and concentric with the reflecting element; and a coaxial connector, coupled to the input end of the conical section, configured to connect the antenna assembly to its corresponding source of microwave or radio frequency energy.

12. The apparatus of claim 1, wherein the outer conductor has an inner diameter at the output end that is larger than the aperture of the reflecting element, the antenna assembly further comprising a conical dielectric insert conforming to the inner diameter of the outer conductor and the outer diameter of the inner conductor, wherein the conical section of transmission line may be sealed against positive pressure of a medium within the chamber.

13. The apparatus of claim 1, wherein a minimum linear dimension of the chamber is comparable to free-space wavelength at a nominal frequency of operation and a maximum volume of the chamber supports approximately 100 unloaded modes within an operating bandwidth.

14. The apparatus of claim 8, further comprising the plurality of antenna assemblies are upon an inner surface of the second end-cap.

15. The apparatus of claim 14, wherein the plurality of antenna assemblies disposed upon the inner surface of the second end-cap is equal in number to the plurality of antenna assemblies disposed upon the inner surface of the first end-cap, spaced at approximately equal angles around the axis of symmetry of the chamber, and rotated by an angle to minimize intercoupling of antennas.

16. The apparatus of claim 15, wherein the angle is approximately one-half of an angular spacing between adjacent antennas in the plurality of antenna assemblies disposed upon the inner surface of the second end-cap.

17. The apparatus of claim 1, wherein the load comprises a material that is capable of absorbing energy at the operating frequency or operating frequencies of microwave or radio frequency field within the chamber, wherein the load is coupled to the plurality of quasi-orthogonal resonant modes and is substantially uniformly irradiated by the microwave or radio frequency field.

18. The apparatus of claim 17, wherein the load is approximately centered at a midplane of the chamber.

19. The apparatus of claim 17, wherein at least one of dimensions of the load is longer than a minimal operating wavelength of the microwave or radio frequency field.

20. The apparatus of claim 17, wherein at least one of dimensions of the load is comparable to or smaller than the penetration skin depth of a load material at the microwave or radio frequency field.

21. An apparatus, comprising:

a chamber configured to support a plurality of quasi-orthogonal resonant modes; and at least one antenna assembly comprising an antenna having a radiating element, wherein (i) the antenna has predominantly linear polarization of radiation defined by a polarization plane, (ii) the radiating element is disposed within the chamber such that the polarization plane is not parallel and not perpendicular to a plane containing a primary axis of the chamber and a central point of the radiating element, and (iii) the antenna is coupled to the chamber through a designated surface of the chamber and coupled to at least one source of microwave or radio frequency energy having an operating frequency and positioned to launch one or more of the plurality of quasi-orthogonal resonant modes to be coupled to a load disposed within the chamber wherein the designated surface of the chamber comprises at least one partially curved surface in a shape of a first end-cap and a second end-cap, each end-cap comprises one-half of an oblate spheroid and is interconnected with a cylindrical insert along matching edges such that a plurality of antenna assemblies having two or more antennas are disposed upon an inner surface of the first end-cap and spaced at approximately equal angles around an axis of symmetry of the chamber wherein the plurality of antenna assemblies are disposed upon an inner surface of the second end-cap.

22. The apparatus of claim 21, wherein the plurality of antenna assemblies disposed upon an inner surface of the second end-cap is equal in number to the plurality of antenna assemblies disposed upon the inner surface of the first end-cap, spaced at approximately equal angles around the axis of symmetry of the chamber, and rotated by an angle to minimize intercoupling of antennas.

23. The apparatus of claim 22, wherein the angle is approximately one-half of an angular spacing between adjacent antennas in the plurality of antenna assemblies disposed upon the inner surface of the second end-cap.

* * * * *